US010195626B2

(12) United States Patent
Fujiwara et al.

(10) Patent No.: US 10,195,626 B2
(45) Date of Patent: Feb. 5, 2019

(54) TRIGGER-TYPE LIQUID DISPENSER

(71) Applicants: Kotaro Fujiwara, Tokyo (JP); Hiroyuki Nakamura, Tokyo (JP); Shigeo Iizuka, Tokyo (JP)

(72) Inventors: Kotaro Fujiwara, Tokyo (JP); Hiroyuki Nakamura, Tokyo (JP); Shigeo Iizuka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 15/522,415

(22) PCT Filed: Nov. 11, 2015

(86) PCT No.: PCT/JP2015/005627

§ 371 (c)(1),
(2) Date: Apr. 27, 2017

(87) PCT Pub. No.: WO2016/084320

PCT Pub. Date: Jun. 2, 2016

(65) Prior Publication Data

US 2017/0348716 A1 Dec. 7, 2017

(30) Foreign Application Priority Data

Nov. 28, 2014 (JP) ..... 2014-241857
Nov. 28, 2014 (JP) ..... 2014-242333

(51) Int. Cl.
*F04B 9/14* (2006.01)
*B05B 11/00* (2006.01)
*B65D 83/00* (2006.01)

(52) U.S. Cl.
CPC ..... *B05B 11/3045* (2013.01); *B05B 11/305* (2013.01); *B05B 11/3009* (2013.01);
(Continued)

(58) Field of Classification Search
CPC ..... B05B 1/3057; B05B 11/3011
(Continued)

(56) References Cited

U.S. PATENT DOCUMENTS 6,619,514 B1 * 9/2003 Costa Quintas .... B05B 11/3001 222/383.1
2012/0032004 A1 * 2/2012 Dejong ..... B05B 11/3011 239/526
2013/0341362 A1 * 12/2013 Hoffmann ..... B05B 1/12 222/383.1

FOREIGN PATENT DOCUMENTS

DE 19948462 A1 9/2000
EP 1013345 A2 6/2000
(Continued)

OTHER PUBLICATIONS

Feb. 16, 2016 International Search Report issued in International Patent Application No. PCT/JP2015/005627.
(Continued)

*Primary Examiner* — Jeremy Carroll
(74) *Attorney, Agent, or Firm* — Oliff PLC

(57) ABSTRACT

A trigger-type liquid dispenser that, even when lateral force is applied to a trigger, prevents liquid leakage. The trigger-type liquid dispenser includes a pump, which includes: a cylinder, which includes an inner tubular wall and an outer tubular wall; a piston, which has a front-side end portion; a front-side sealing piece and a rear-side sealing piece; an outer-circumferential-side support portion; and an inner-circumferential-side support portion. The outer-circumferential-side support portion is provided with an annular cut-off portion, which forms a gap between the outer-circumferential-side support portion and an outer circumferential surface of the piston.

2 Claims, 13 Drawing Sheets

(52) U.S. Cl.
CPC ..... *B05B 11/3011* (2013.01); *B05B 11/3057* (2013.01); *B05B 11/3077* (2013.01); *B65D 83/00* (2013.01); *F04B 9/14* (2013.01); *B05B 11/3023* (2013.01); *B05B 11/3032* (2013.01); *B05B 11/3067* (2013.01)

(58) Field of Classification Search
USPC ..... 222/383.1
See application file for complete search history.

(56) References Cited

FOREIGN PATENT DOCUMENTS

| | | | | |
|---|---|---|---|---|
| EP | 1190776 | A1 | | 3/2002 |
| JP | H10-277446 | A | | 10/1998 |
| JP | 2000-302154 | A | | 10/2000 |
| JP | 2005-211807 | A | | 8/2005 |
| JP | 2009131799 | A | * | 6/2009 |
| JP | 2011-073719 | A | | 4/2011 |
| JP | 2012-096144 | A | | 5/2012 |
| JP | 2015-085289 | A | | 5/2015 |
| WO | 2014/016709 | A1 | | 1/2014 |

OTHER PUBLICATIONS

May 30, 2017 International Preliminary Report on Patentability issued in International Patent Application No. PCT/JP2015/005627.
Sep. 5, 2018 Office Action issued in Chinese Patent Application No. 201580061824.2.
May 30, 2018 Search Report issued in European Patent Application No. 15862675.4.
Jun. 5, 2018 Office Action issued in Japanese Patent Application No. 2014-242333.

* cited by examiner

A-A section

B-B section

A view

B-B section

C-C section

TRIGGER-TYPE LIQUID DISPENSER

TECHNICAL FIELD

The present disclosure relates to a trigger-type liquid dispenser that is attached to a mouth of a container containing a liquid and that dispenses the liquid contained in the container through a nozzle in the form of spray or foam.

BACKGROUND

As a dispenser attached to a mouth of a container containing a liquid, such as an antimold, a detergent, a sizing agent for textiles, household wax, a hair liquid, and an aromatic, a trigger-type liquid dispenser is widely used. Such a trigger-type liquid dispenser may dispense the liquid through a nozzle in the form of spray or foam with use of a pump configured to be actuated in response to operation of a trigger.

Such a trigger-type liquid dispenser also includes a dispenser main body fitted to the mouth of the container by, for example, a fitting cap, and the dispenser main body is provided with a flow path communicating with the container, and the nozzle is fitted on the downstream side of the flow path. The pump is connected to the midway of the flow path, and, when the pump is actuated, the liquid contained in the container is pressure-fed along the flow path and dispensed to the outside through the nozzle.

Furthermore, such a trigger-type liquid dispenser, as commonly used, includes a pump including a cylinder and a piston. In this case, the piston is provided, on an outer circumferential surface thereof, integrally with a sealing piece, which protrudes to the outer side in the radial direction from the outer circumferential surface and which is in sliding contact with an inner circumferential surface of the cylinder for sealing between the cylinder and the piston. The piston also has a front-side end portion engaged with the trigger, and, as the trigger is operated, the piston is pushed into the cylinder to pressure-feed the liquid to the flow path. (Refer, for example, to Patent Literature 1.)

CITATION LIST

Patent Literature

PTL 1: JP2000302154A

SUMMARY

Technical Problem

However, since in the conventional trigger-type liquid dispenser the front-side end portion of the piston is engaged with the trigger, the following problem arises. For example, assume that the container fitted with the trigger-type liquid dispenser is placed together with other products in a shopping cart or the like, and that the trigger is pushed in the horizontal direction (to the lateral side). Assume also that the trigger is operated in the oblique direction during use. In such a situation, lateral force is applied to the trigger, and the piston may be tilted with respect to the cylinder. The tilting of the piston with respect to the cylinder causes excessive deformation of the sealing piece, thereby deteriorating sealing performance between the piston and the cylinder. This might lead to liquid leakage.

The present disclosure is to solve the above problem, and the present disclosure is to provide a trigger-type liquid dispenser that, even when lateral force is applied to the trigger, prevents liquid leakage.

Solution to Problem

One of aspects of the present disclosure resides in a trigger-type liquid dispenser including a dispenser main body fitted to a mouth of a container containing a liquid, a nozzle disposed on a downstream side of a flow path provided in the dispenser main body, and a pump that is actuated in response to operation of a trigger to pressure-feed the liquid contained in the container to the nozzle through the flow path. The pump includes: a cylinder that has a coaxial double-wall configuration including an inner tubular wall and an outer tubular wall and that communicates with the flow path; a piston that is fitted displaceably between the inner tubular wall and the outer tubular wall in a direction extending along a center axis of the cylinder and that has a front-side end portion engaged with the trigger; a front-side sealing piece and a rear-side sealing piece that each are provided integrally in the piston and that each abut against an inner circumferential surface of the outer tubular wall in a liquid-tight manner; an outer-circumferential-side support portion that is provided integrally in the piston on a front side of the front-side sealing piece and that slidably abuts against the inner circumferential surface of the outer tubular wall; and an inner-circumferential-side support portion that is provided integrally on at least one of an outer circumferential surface of the inner tubular wall and an inner circumferential surface of the piston and that slidably abuts against another one of the outer circumferential surface of the inner tubular wall and the inner circumferential surface of the piston. The outer-circumferential-side support portion is provided with an annular cut-off portion that forms a gap between the outer-circumferential-side support portion and an outer circumferential surface of the piston.

In a preferred embodiment, the inner-circumferential-side support portion is configured by a plurality of projections that is disposed at an interval in a circumferential direction.

In another preferred embodiment, the piston is provided with a coupling wall that protrudes from the outer circumferential surface of the piston toward the outer tubular wall, and the outer-circumferential-side support portion is configured by an annular wall and projections, the annular wall being coupled to an outer circumferential end of the coupling wall and extending to the front side, and the projections being provided on an outer circumferential surface of the annular wall at an interval in a circumferential direction to slidably abut against the inner circumferential surface of the outer tubular wall.

In a yet another preferred embodiment, the front-side sealing piece is formed in an umbrella shape that is coupled to the annular wall on a rear side of the projections and that has a diameter increasing toward the rear side, and the rear-side sealing piece is formed in an umbrella shape that is coupled to the outer circumferential end of the coupling wall and that has a diameter increasing toward the rear side.

Advantageous Effect

In the present disclosure, the outer-circumferential-side support portion, which slidably abuts against the inner circumferential surface of the outer tubular wall, is provided on the front side of the front-side sealing piece provided in the piston, and the inner-circumferential-side support portion is provided on at least one of the outer circumferential surface of the inner tubular wall and the inner circumferential surface of the piston to slidably abut against the other one of the outer circumferential surface of the inner tubular wall and the inner circumferential surface of the piston. Accordingly, when lateral force is applied to the trigger, the support portions support lateral load applied to the piston and prevent tilting of the piston with respect to the cylinder. This permits the sealing pieces to abut against the cylinder stably. Furthermore, the outer-circumferential-side support portion is provided with the annular cut-off portion that forms the gap between the outer-circumferential-side support portion and the outer circumferential surface of the piston. Accordingly, even when the tilting of the piston is increased, the tilting is less likely to proceed to the sealing pieces, and liquid leakage from a portion of the pump is prevented.

DETAILED DESCRIPTION

Figure 1:
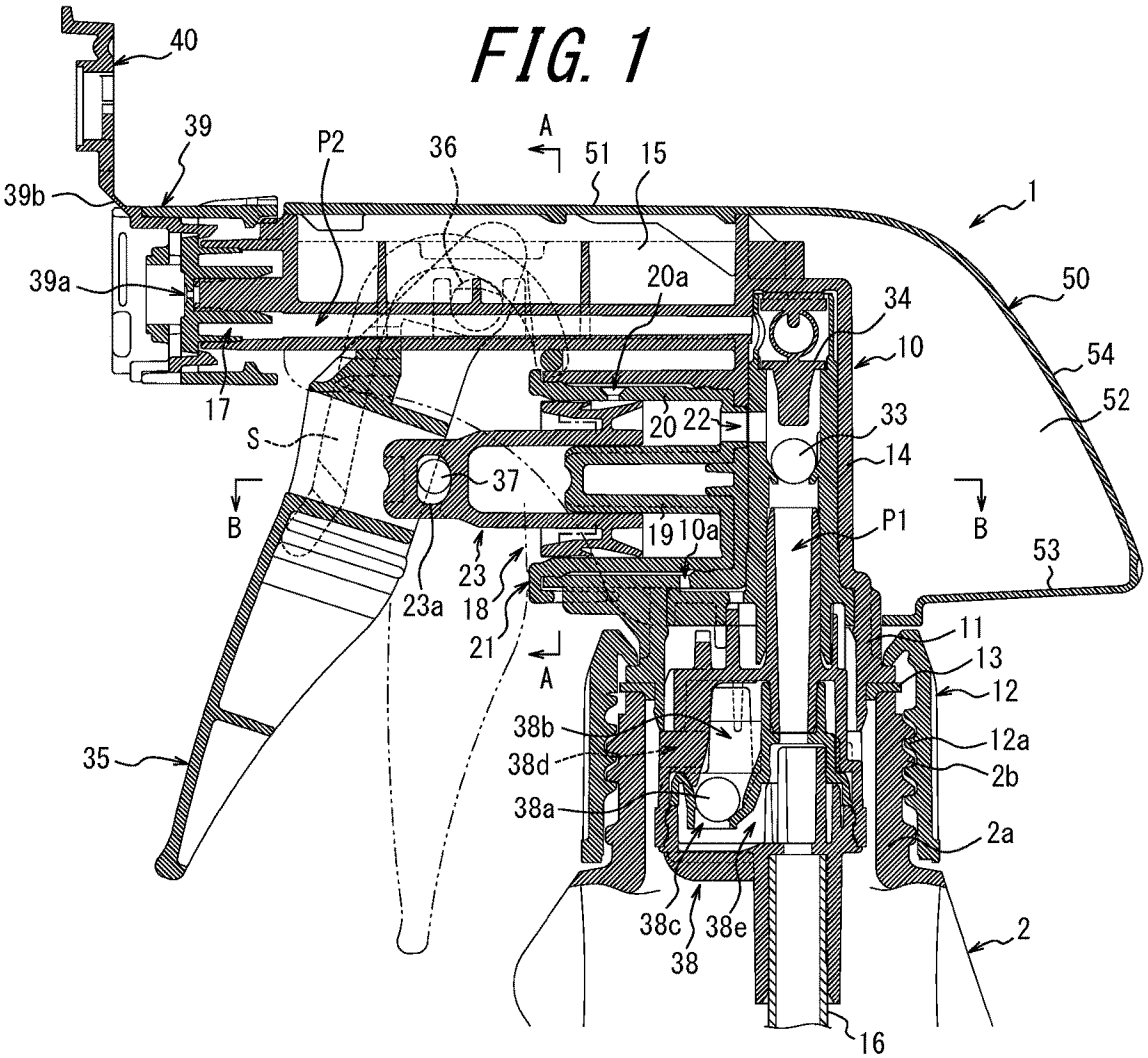
FIG. 1 is a sectional view illustrating a trigger-type liquid dispenser according to one of embodiments of the present disclosure.

A trigger-type liquid dispenser according to one of embodiments of the present disclosure will be described in detail below with reference to the drawings. Note that, in the present specification, claims, abstract, and drawings, the side on which a shroud is located with respect to a fitting cap which is later described is defined as upward (the upper side in FIG. 1), and the opposite side is defined as downward (the lower side in FIG. 1). Furthermore, the side on which a trigger is located with respect to a piston is defined as forward (the left side in FIG. 1), and the opposite side is defined as rearward (the right side in FIG. 1). Moreover, the directions that are orthogonal to the upper-lower direction and the front-rear direction (the directions that are orthogonal to the drawing in FIG. 1) are defined as lateral sides (left and right directions).

In the figure, reference numeral 1 denotes a trigger-type liquid dispenser according to one of embodiments of the present disclosure. The trigger-type liquid dispenser 1 is attached to a mouth 2*a* of a container 2 for use. The container 2 contains, for example, a liquid such as an antimold as a content liquid. FIG. 1 illustrates a state in which the trigger-type liquid dispenser 1 is attached to the mouth 2*a* of the container 2.

The trigger-type liquid dispenser 1 includes a resin-made dispenser main body 10, which is attached to the mouth 2*a* of the container 2. The dispenser main body 10 includes, in a lower end thereof, a coupling tube 11, to which a fitting cap 12 is held in a manner such that the fitting cap 12 is relatively rotatable. The fitting cap 12 is formed in a cylindrical shape and provided, on an inner circumferential surface thereof, with a female screw 12*a*. The dispenser main body 10 is fixed to the mouth 2*a* of the container 2 by screw-connecting the female screw 12*a* to a male screw 2*b*, which is provided on an outer circumferential surface of the mouth 2*a* of the container 2, while the coupling tube 11 is fitted to the mouth 2*a* of the container 2. Additionally, reference numeral 13 denotes a sealing member that seals between the mouth 2*a* of the container 2 and the coupling tube 11.

The dispenser main body 10 is formed in a substantially L-shape including a standing portion 14, which extends from the coupling tube 11 in a direction extending along the center axis of the coupling tube 11, and also including an extension portion 15, which extends in a direction orthogonal to the standing portion 14. The standing portion 14 is provided, inside thereof, with a standing flow path P1, which communicates with the coupling tube 11, and the standing flow path P1 has a lower end to which a drawing tube 16, which is inserted into the container 2, is connected. On the other hand, the extension portion 15 is provided with an extension flow path P2, which extends in the direction orthogonal to the standing flow path P1. The extension flow path P2 is provided, on the downstream side thereof, with a delivery port 17.

Furthermore, the trigger-type liquid dispenser 1 includes a pump 18. The pump 18 includes an inner tubular wall 19 and an outer tubular wall 20 and also includes a cylinder 21, which is attached to the dispenser main body 10. The cylinder 21 is provided with an outlet/inlet hole 22, and the inside of the cylinder 21 communicates with the standing flow path P1 via the outlet/inlet hole 22.

Figure 2:
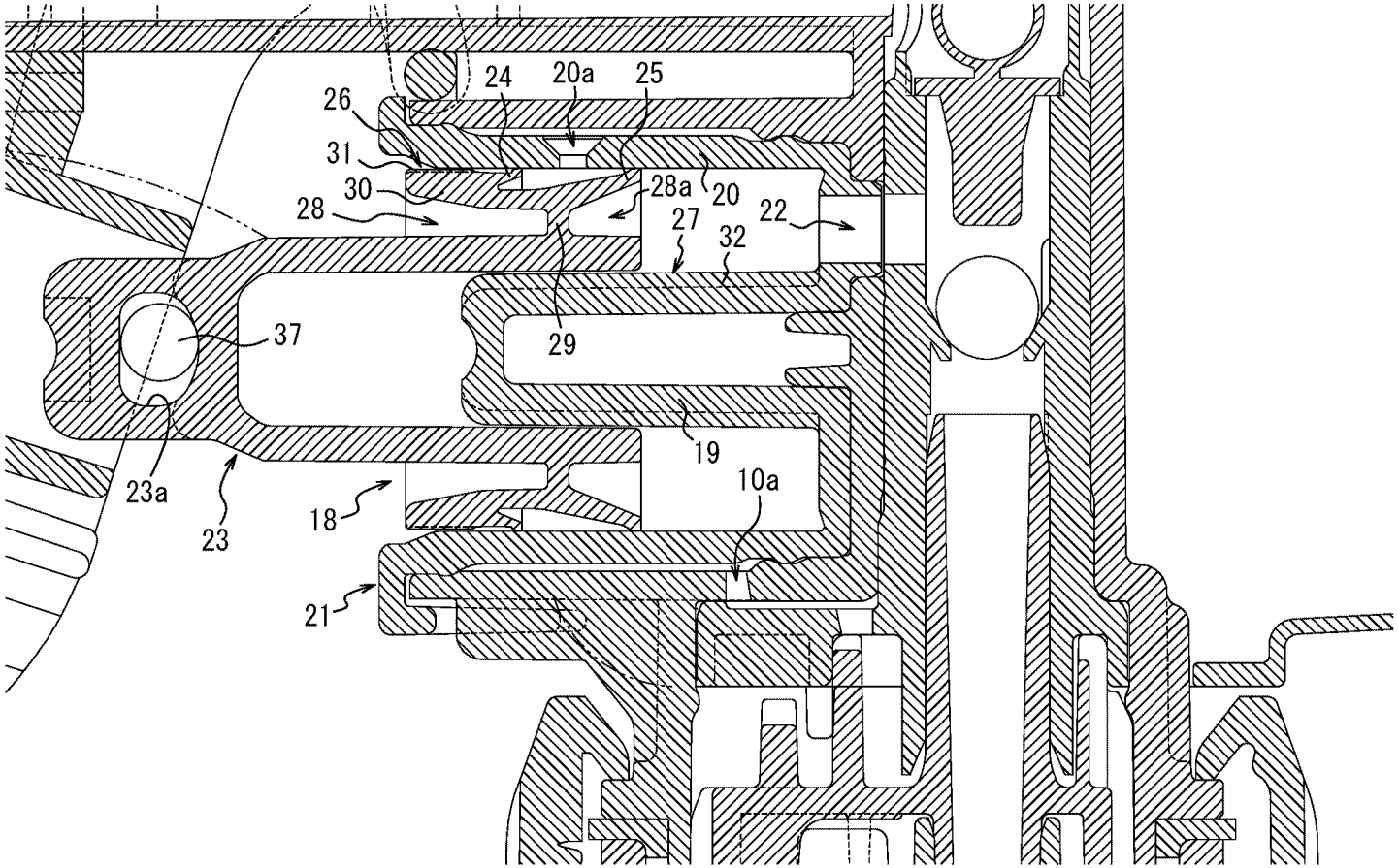
FIG. 2 is a partial enlarged view of FIG. 1.

Between the inner tubular wall 19 and the outer tubular wall 20, there is disposed a piston 23, which is fitted displaceably in a direction extending along the center axis of the cylinder 21. As illustrated in FIG. 2, the piston 23 is provided with a front-side sealing piece 24 and a rear-side sealing piece 25, which abut against an inner circumferential surface of the outer tubular wall 20 in a liquid-tight manner. The piston 23 is also provided with an outer-circumferential-side support portion 26, which is provided integrally with the piston 23 on the front side of the front-side sealing piece 24 and which slidably abuts against the inner circumferential surface of the outer tubular wall 20. The piston 23 has an inner circumferential surface, which slidably abuts against an inner-circumferential-side support portion 27, which is provided on an outer circumferential surface of the inner tubular wall 19. Although the outer-circumferential-side support portion 26 and the inner-circumferential-side support portion 27 may abut against the inner circumferential surface of the outer tubular wall 20 and the inner circumferential surface of the piston 23 around the entire circumferences thereof, as described later below, these portions 26 and 27 are in partial abutment in the circumferential direction in the present embodiment. The outer-circumferential-side support portion 26 is disposed along the center axis of the piston 23, and the outer-circumferential-side support portion 26 is also provided with an annular cut-off portion 28, which forms a gap between the outer-circumferential-side support portion 26 and an outer circumferential surface of the piston 23.

In the present embodiment herein, the piston 23 is provided with an annular coupling wall 29, which protrudes from the outer circumferential surface of the piston 23 toward the outer tubular wall 20. The aforementioned outer-circumferential-side support portion 26 is configured by an annular wall 30, which is coupled to an outer circumferential end of the coupling wall 29 and which extends to the front side, and a plurality of annular wall projections 31 (refer to FIGS. 3 and 4), which is provided on an outer circumferential surface of the annular wall 30 at an interval in the circumferential direction and which slidably abuts against the inner circumferential surface of the outer tubular wall 20. Furthermore, the front-side sealing piece 24 is formed in an umbrella shape which is coupled to the annular wall 30 on the rear side of the annular wall projections 31 and which has a diameter increasing toward the rear side. In this case, the aforementioned cut-off portion 28 is formed between the annular wall 30 and the outer circumferential surface of the piston 23. Moreover, the rear-side sealing piece 25 is formed in an umbrella shape which is coupled to the outer circumferential end of the coupling wall 29 and which has a diameter increasing toward the rear side. In this case, a rear-side cut-off portion 28*a* is formed between the rear-side sealing piece 25 and the outer circumferential surface of the piston 23. The above configuration allows the piston 23 to be formed easily by, for example, injection molding using a mold.

Figure 3:
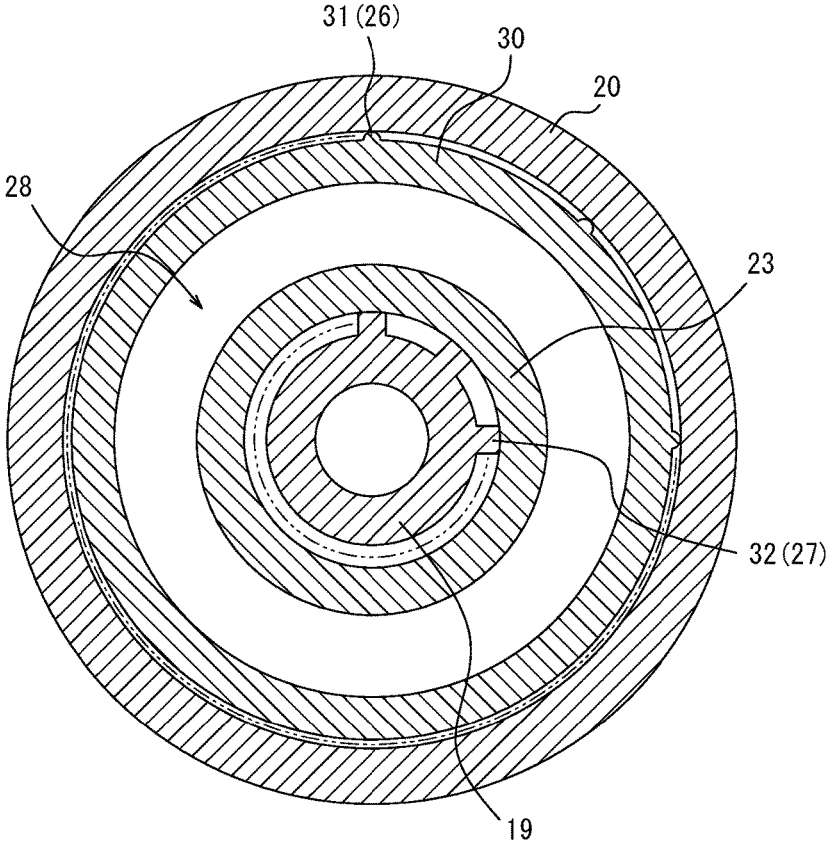
FIG. 3 is a sectional view (illustrating only a cylinder and a piston) taken along A-A in FIG. 1.
Figure 4:
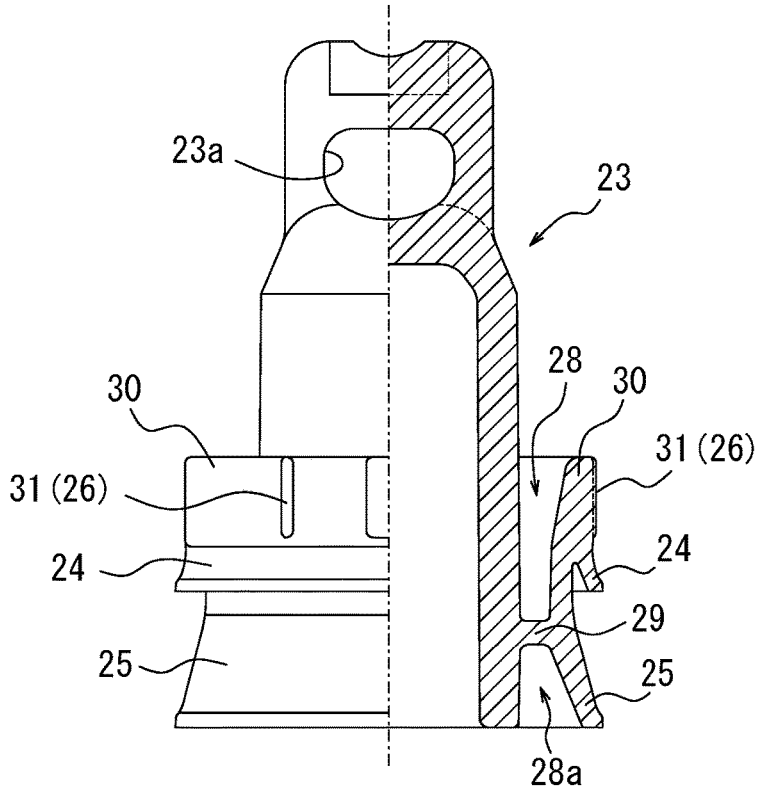
FIG. 4 is a half sectional view illustrating a piston of FIG. 1.

As illustrated in FIG. 3, the inner-circumferential-side support portion 27 in the present embodiment is configured by a plurality of projections 32, which is disposed at an interval in the circumferential direction on the outer circumferential surface of the inner tubular wall 19. The projections 32 may also be provided on the inner circumferential surface of the piston 23, so that the projections 32 abut against the outer circumferential surface of the inner tubular wall 19.

As illustrated in FIG. 1, the outer tubular wall 20 is provided with an air intake hole 20*a*, which is exposed to the outside when the piston 23 is displaced to its stroke end by the trigger which is described later. The dispenser main body 10 is also provided with a vent hole 10*a*, through which the inside of the container 2 communicates with the air intake hole 20*a*. Accordingly, when the liquid contained in the container 2 is dispensed by actuating the pump 18, ambient air is drawn into the container 2 through the air intake hole 20*a*, and the ambient air replaces the liquid contained in the container 2.

As illustrated in FIG. 1, the standing flow path P1 is provided, on the upstream side of the outlet/inlet hole 22 (on the lower side of the outlet/inlet hole 22 in FIG. 1), with the first check valve 33. The first check valve 33 operates to allow the liquid to flow from the inside of the container 2 toward the outlet/inlet hole 22 and to prevent the liquid, after being discharged through the outlet/inlet hole 22 in response to actuation of the pump 18, from flowing toward the container 2 through the standing flow path P1. The standing flow path P1 is also provided, on the downstream side of the outlet/inlet hole 22 (on the upper side of the outlet/inlet hole 22 in FIG. 1), with the second check valve 34. The second check valve 34 operates to allow the liquid, after being discharged through the outlet/inlet hole 22 in response to actuation of the pump 18, to flow toward the delivery port 17 through the standing flow path P1 and the extension flow path P2 and to prevent the liquid from flowing from the delivery port 17 toward the outlet/inlet hole 22.

The dispenser main body 10 is provided with the operating lever (trigger) 35. The trigger 35, on its one end side, is supported swingably by the dispenser main body 10 about a pivot shaft 36. The trigger 35 is provided, in a middle portion thereof, with a pin member 37, which engages with a concave portion 23*a*, which is provided in a front-side end portion of the piston 23. With the trigger T, a front end of a curve-shaped plate spring S, which has a base end fixed to and held by the dispenser main body 10, is engaged. The plate spring S urges the trigger 35 toward a direction (i.e., a clockwise direction about the pivot shaft 36 in FIG. 1) away from the pump 18.

When the trigger 35 is pulled toward the pump 18, the first check valve 33 is closed, and the piston 23 increases the liquid pressure inside the cylinder 21. Consequently, the liquid contained in the cylinder 21 is delivered from the outlet/inlet hole 22 into the extension flow path P2 through the second check valve 34. On the other hand, when the trigger 35 is released from the pulling operation, the trigger 35 is returned to its initial position due to resilience of the plate spring S. In conjunction with the return movement, the second check valve 34 is closed, the first check valve 33 is opened, and the liquid contained in the container 2 is drawn from the outlet/inlet hole 22 into the cylinder 21 via the tube 16 and the standing flow path P1. By thus repeating pulling and releasing operations of the trigger 35, the pump 18 may be actuated to draw the liquid contained in the container 2 through the standing flow path P1 and to pressure-feed the liquid to the delivery port 17 through the extension flow path P2.

In the present embodiment, between the standing flow path P1 and the tube 16, there is provided an upright and inverted dual mechanism 38, which permits the liquid contained in the container 2 to be supplied to the pump 18 regardless of whether the container 2, to which the trigger-type liquid dispenser 1 is fitted, is in an upright or an inverted position. When the container 2 is in the upright position, the upright and inverted dual mechanism 38 is in a closed state where a ball-shaped valve body 38*a* closes an outlet hole 38*c* of a valve chamber 38*b*, so that the liquid may be introduced to the standing flow path P1 via the tube 16. On the other hand, when the container 2 is in the inverted position, the upright and inverted dual mechanism 38 is brought into an opened state by the valve body 38*a* being displaced in the valve chamber 38*b* in a direction away from the outlet hole 38*c*, so that the liquid pooled inside the coupling tube 11 may be introduced from an inlet hole 38*d* to the standing flow path P1 via the valve chamber 38*b*, the outlet hole 38*c*, and a flow path 38*e*, which is used during inversion. Thus, the liquid contained in the container 2 may be supplied to the pump 18 both in the upright and inverted positions.

To the extension portion 15 of the dispenser main body 10, a nozzle 39 is fitted to communicate with the delivery port 17. The nozzle 39 is provided with a dispensing hole 39*a* and configured to dispense the liquid, after being pressure-fed from the container 2 to the delivery port 17 by the pump 18, to the outside through the dispensing hole 39*a*.

The nozzle 39 may be fitted rotatably to the extension portion 15 and may be configured to switch the liquid to be delivered from the delivery port 17 between a spray dispensing mode and a closed mode. Additionally, a linearly dispensing mode or a foam discharging mode may also be provided instead or supplementarily. The nozzle 39 includes, on the front side thereof, a cover 40, which is configured to be opened and closed via a hinge 39*b*. By opening and closing the cover 40, the nozzle 39 may be configured to change the foam quality of the dispensed liquid.

To the dispenser main body 10, a shroud 50, which covers a majority of the dispenser main body 10 and the pump 18, is also fitted. The trigger 35 protrudes from the lower side of the shroud 50 and swings without interfering with the shroud 50.

In the trigger-type liquid dispenser 1 configured as above, since the annular wall projections 31 slidably abut against the inner circumferential surface of the outer tubular wall 20 and since the projections 32 slidably abut against the inner circumferential surface of the piston 23 as illustrated in FIGS. 2 and 3, the piston 23 is displaced linearly along the center axis of the cylinder 21. Accordingly, the front-side sealing piece 24 and the rear-side sealing piece 25 abut against the inner circumferential surface of the outer tubular wall 20 stably, and sealing performance between the cylinder 21 and the piston 23 is secured sufficiently.

Figure 5A:
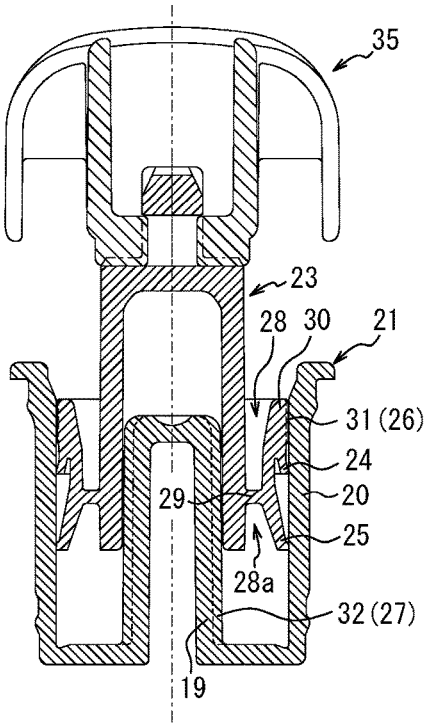
FIGS. 5A and 5B illustrate a principle of preventing deformation of a sealing piece by way of sectional views (illustrating only a trigger, a piston, and a cylinder) taken along B-B in FIG. 1, with FIG. 5A illustrating a normal state and with FIG. 5B illustrating a state in which lateral force is applied to the trigger.
Figure 5B:
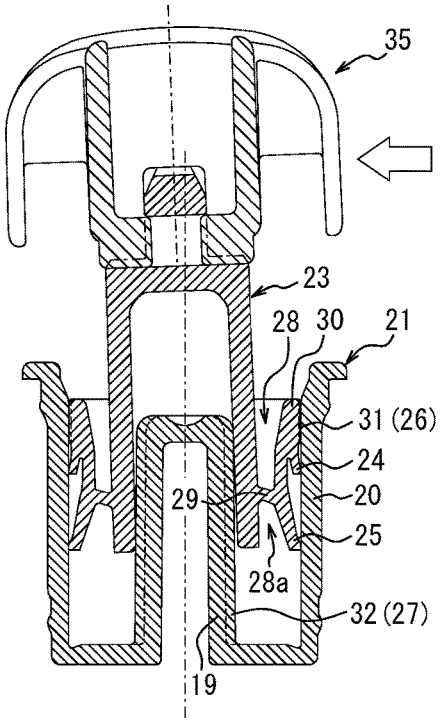

Furthermore, when lateral force is applied to the trigger 35, the piston 23, which engages with the trigger 35, will be tilted from the state illustrated in FIG. 5A to the state illustrated in FIG. 5B. Nevertheless, since the cut-off portion 28 is provided in the piston 23 and since the annular wall projections 31, which are provided on the annular wall 30, are adjacent to the outer tubular wall 20, the tilting of the piston 23 is absorbed by the coupling wall 29. This reduces the effect on the front-side sealing piece 24 and the rear-side sealing piece 25 caused by the tilted piston 23, thereby preventing liquid leakage effectively. In the present embodiment, due to the rear-side cut-off portion 28*a*, which increases an acceptable degree of deformation of the coupling wall 29, the effect caused by the tilted piston 23 is further reduced. This allows a high level of liquid leakage prevention.

Moreover, in the present embodiment, due to the two sealing pieces of the front-side sealing piece 24 and the rear-side sealing piece 25, liquid leakage prevention is ensured.

As can be seen from FIGS. 6 to 8C, the shroud 50 includes a ceiling wall 51, which is disposed above the dispenser main body 10 to cover the upper side of the dispenser main body 10, a pair of side walls 52, which are connected to both sides of the ceiling wall 51 and extend downward to cover the lateral sides of the dispenser main body 10, a bottom wall 53, which is connected to rear-side lower ends of the pair of side walls 52, and a tilted rear end wall 54, which is connected to the walls 51 to 53 and which faces toward the rear side.

The shroud 50 is slide-fitted to the dispenser main body 10 from the rear side to the front side thereof. Accordingly, the shroud 50 is provided, on inner surfaces of the side walls 52, with guide rails 60. The dispenser main body 10 is also provided, on side portions thereof, with guide grooves 70, which guide the guide rails 60 in a sliding manner.

Figure 8A:
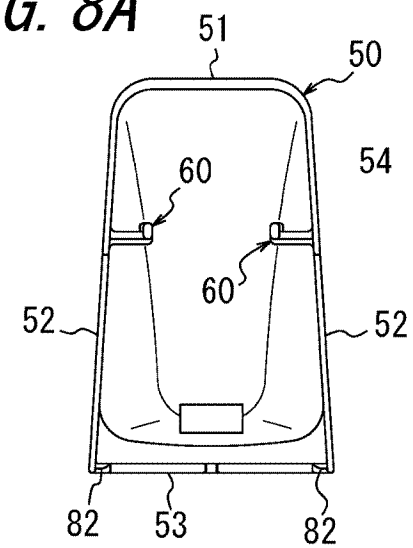
FIGS. 8A, 8B, and 8C are respectively a front view, a side view, and a bottom view of a shroud.
Figure 8B:
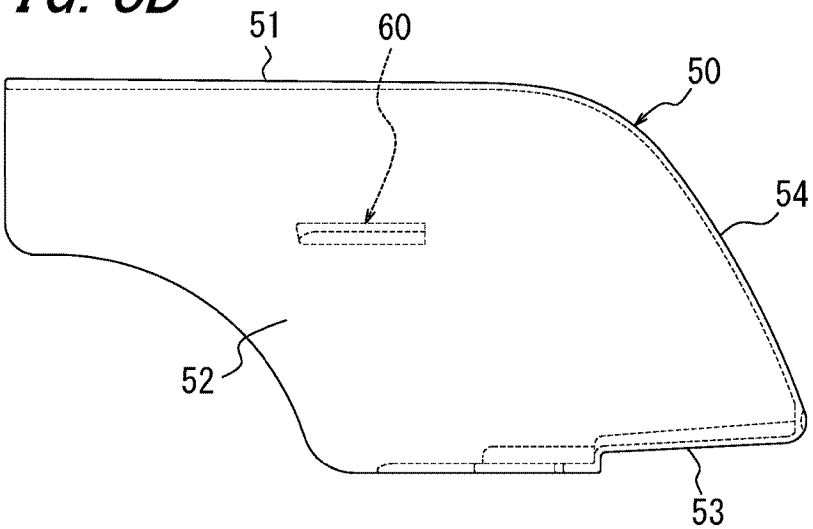
Figure 8C:
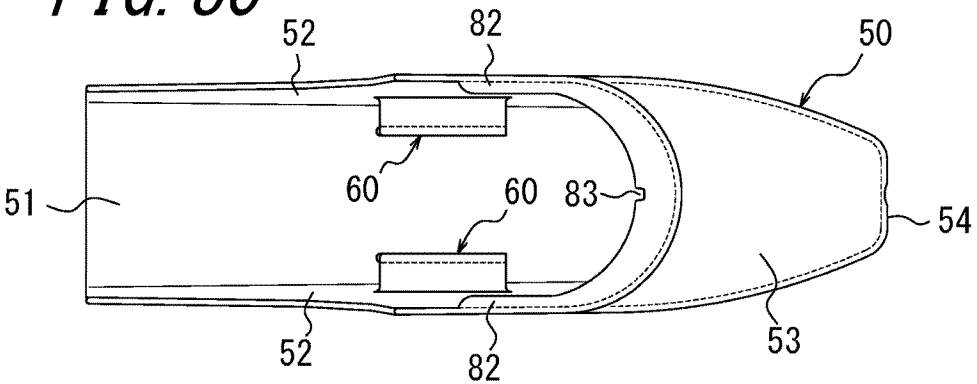

As illustrated in FIG. 8A to 8C, each of the pair of guide rails 60 is located substantially in the middle in the height direction and substantially in the middle in the front-rear direction on the inner surface of the corresponding side wall 52 of the shroud 50. The guide rails 60 on the left and the right are symmetrical and have substantially the same shape, and accordingly, a description is given only of one of the guide rails 60.

As illustrated in FIG. 9, the guide rail 60, in its section, is formed in an L-shape including a horizontal rail portion 61 and a flat-plate-shaped vertical rail portion 62. The horizontal rail portion 61 is formed in a flat plate shape that is perpendicular with respect to the upper-lower direction, that protrudes from the inner surface of the corresponding side wall 52 of the shroud 50 toward the dispenser main body 10, and that extends over a predetermined length along the front-rear direction. The vertical rail portion 62 is perpendicularly connected to an inner-side end edge of the horizontal rail portion 61 over the entire range thereof in the front-rear direction. The guide rail 60 has a front-side end that has a rounded shape so that the guide rail 60 may be inserted to the corresponding guide groove 70 easily.

As illustrated in FIG. 8B, the length of the guide rail 60 in the front-rear direction is sufficiently smaller than the length of the side wall 52 of the shroud 50 in the front-rear direction. Furthermore, the front end portion of the guide rail 60 is located away from the front end edge of the side wall 52 of the shroud 50, and the rear end portion of the guide rail 60 is also located away from the rear end edge of the side wall 52, namely, the rear end wall 54, of the shroud 50.

Figure 9A:
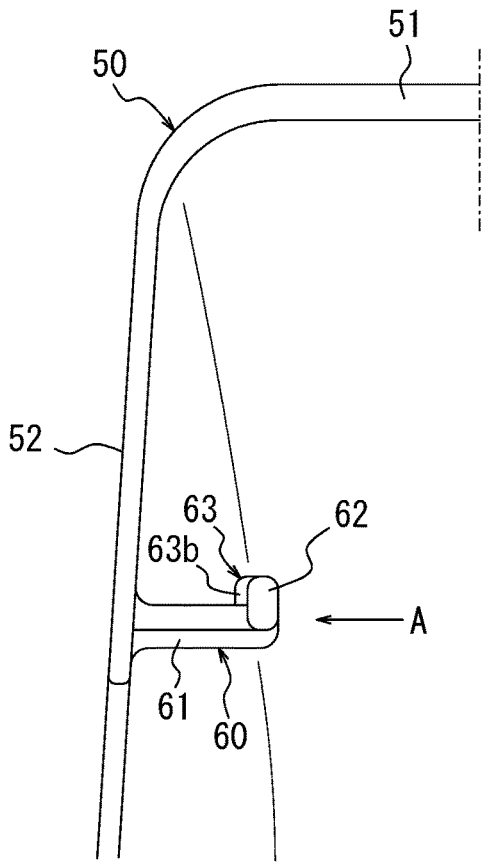
FIG. 9A is a front view illustrating a guide rail provided in a side wall of a shroud.
Figure 9B:
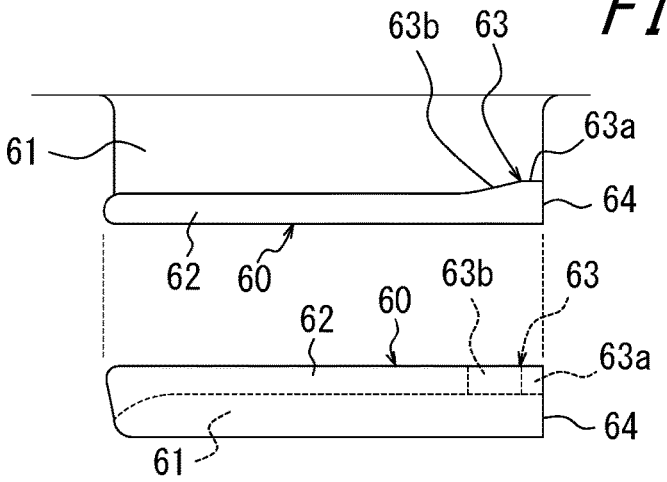
FIG. 9B illustrates a view A in FIG. 9A along with a plan view thereof.

As illustrated in FIGS. 9A and 9B, the guide rail 60 is also provided integrally with an engagement projection 63. The engagement projection 63 is provided on the inner surface of the rear end portion of the vertical rail portion 62 that faces to the side wall 52 (that is coupled to the horizontal rail portion 61), and the engagement projection 63 protrudes from the inner surface toward the side wall 52. The most protruding portion of the engagement projection 63 forms a flat surface 63*a*, which extends in parallel with the vertical rail portion 62. On the front side of the flat surface 63*a*, the engagement projection 63 also includes a tilted surface 63*b*, whose height increases gradually from the front end side toward the rear end side of the guide rail 60. The engagement projection 63 further includes a rear end surface that is formed to be flush with the rear end surface of the vertical rail portion 62. The rear end surface of the engagement projection 63 forms an engagement surface 64, which is used for undercut engagement of the guide rail 60.

The shroud 50 is formed by injection molding a resin material by using a mold. The mold used to mold the shroud 50 includes an inner mold section and an outer mold section that is assembled to the exterior of the inner mold section from the rear side. The ceiling wall 51, the side wall 52, the bottom wall 53, and the rear end wall 54 are molded between the inner and outer mold sections. The inner mold section is provided, in a middle portion in the upper-lower direction thereof, with a stripper used to remove the molded shroud 50 from the inner mold section. The stripper is relatively displaceable toward the rear side with respect to the inner mold section. The stripper is provided, on an upper surface thereof, with a stepped portion extending from the rear end side, and the inner mold section is provided, on an inner surface thereof, with a stepped portion extending from the front side. A gap formed between these stepped portions helps mold the guide rail 60 in an undercut shape integrally with the side wall 52 of the shroud 50.

After the shroud 50 is molded, the mold is opened, and the stripper is displaced rearward. By doing so, the molded shroud 50 is pushed rearward by the stripper and removed from the inner mold section. Furthermore, the stripper has a lower end surface that is inclined. As being displaced rearward, the stripper is displaced downward along the inclination. With the above configuration, while the molded shroud 50 is pushed rearward by the stripper, the guide rail 60 is released from the stepped portion by letting the stripper escape to the lower side with respect to the molded guide rail 60. Thus, the shroud 50, along with the integrally molded guide rail 60, is removed from the inner mold section easily.

On the other hand, as illustrated in FIG. 10, the guide groove 70, which is disposed in each side portion of the dispenser main body 10, is defined and formed by a recess 71, which is provided in the side portion of the dispenser main body 10 to extend in the front-rear direction, and a partition wall 72, which is disposed on the upper side of the recess 71 and which has an L-shaped section. The guide groove 70 is formed in an L-shape including a horizontal groove 73, which extends in the left-right direction in the side portion of the dispenser main body 10, and a vertical groove 74, which extends upward from a base portion of the horizontal groove 73. The width of the horizontal groove 73 is slightly greater than the thickness of the horizontal rail portion 61. On the other hand, the width of the vertical groove 74 is slightly greater than the thickness of the vertical rail portion 62, and accordingly, the vertical rail portion 62 may be displaced within the vertical groove 74 in the thickness direction over a height over which the engagement projection 63 protrudes.

Furthermore, as illustrated in FIGS. 6, 10A, 10B, 12, and 13, disengagement prevention ribs 76 extend from both the side portions of the dispenser main body 10 toward the side walls 52 of the shroud 50. Each disengagement prevention rib 76 serves to support the corresponding guide rail 60 from below when the guide rail 60 reaches its stroke end position.

When the guide rail 60 is inserted to the corresponding guide groove 70 from the rear side, that is to say, the insertion end side, the horizontal groove 73 of the guide groove 70 engages with the horizontal rail portion 61 of the guide rail 60. This restricts the displacement of the guide rail 60 in the upper-lower direction with respect to the dispenser main body 10, that is to say, the displacement of the shroud 50 in the upper-lower direction with respect to the dispenser main body 10. Furthermore, when the guide rail 60 is inserted to the guide groove 70, the vertical groove 74 of the guide groove 70 engages with the vertical rail portion 62 of the guide rail 60. This restricts the displacement of the guide rail 60 to the lateral side with respect to the dispenser main body 10, that is to say, the displacement of the shroud 50 to the lateral side with respect to the dispenser main body 10.

As illustrated in FIGS. 10A to 11C, the dispenser main body 10 is provided, at the insertion end, that is to say, in the rear end portion of the guide groove 70 of the dispenser main body 10, with an engagement surface 75, which is formed vertically with respect to the direction in which the guide groove 70 extends and which faces to the front side. An opening width at the insertion end of the guide groove 70, that is to say, a gap between the engagement surface 75 and the partition wall 72, is set to be greater than the thickness of the vertical rail portion 62 of the guide rail 60 but smaller than the thickness of the rear end portion of the vertical rail portion 62 in which the engagement projection 63 is provided. When the rear end portion of the vertical rail portion 62 passes through the insertion end of the guide groove 70, the partition wall 72 is deformed to enlarge the gap.

Figure 11A:
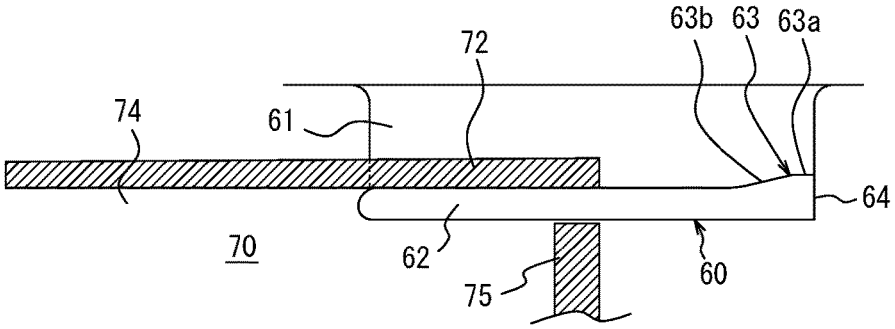
FIGS. 11A to 11C illustrate how a guide rail is inserted to a guide groove and brought into undercut engagement with an engagement surface.
Figure 11B:
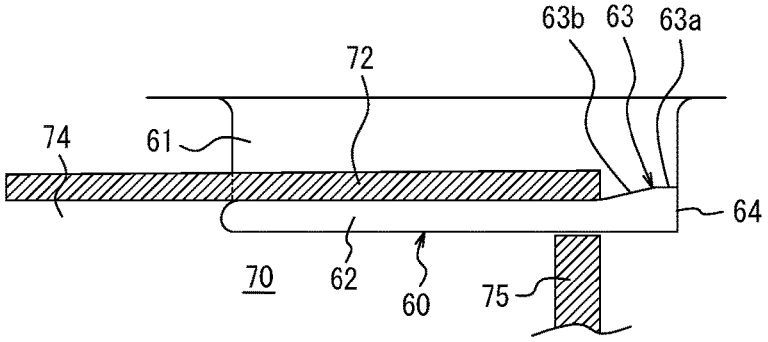
Figure 11C:
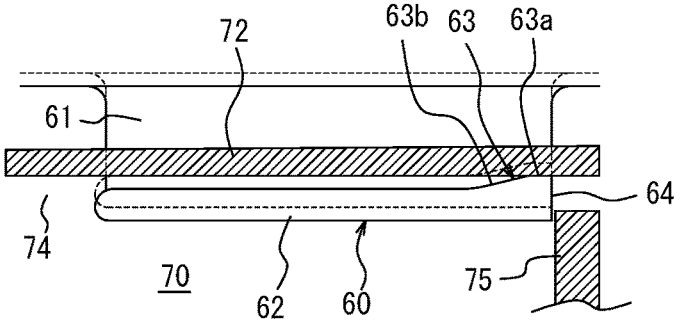
Figure 12:
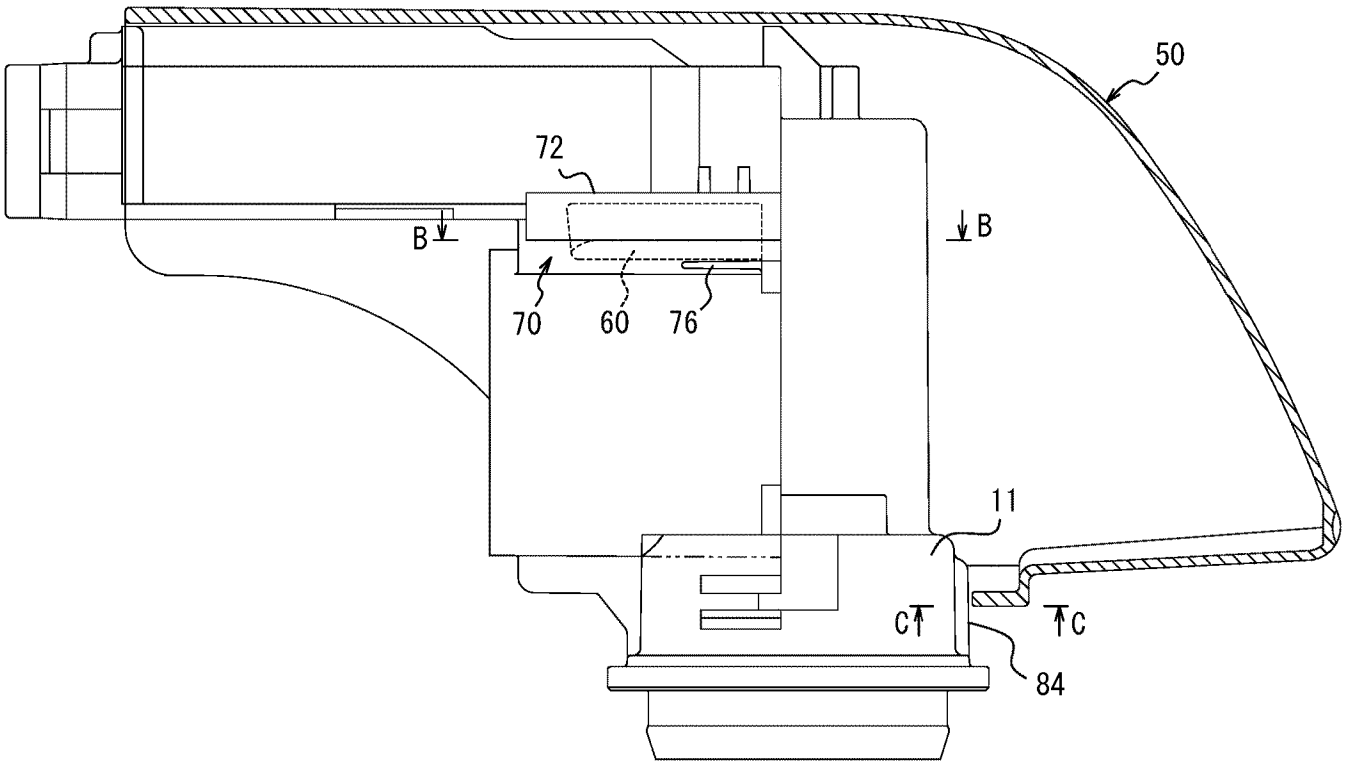
FIG. 12 is a side view illustrating a trigger-type liquid dispenser.
Figure 13:
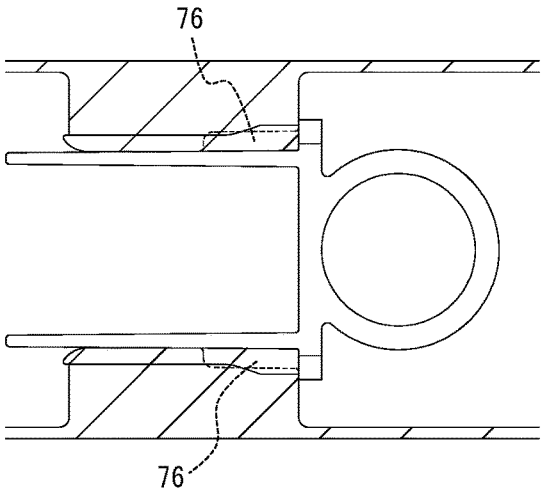
FIG. 13 is a sectional view taken along B-B in FIG. 12.

With the above structure, the shroud 50 may be slide-fitted to the dispenser main body 10 by inserting the guide rail 60, which is provided in the shroud 50, to the guide groove 70, which is provided in the dispenser main body 10, to be guided by the guide groove 70. At this time, as the front end portion of the guide rail 60 is inserted into the insertion end of the guide groove 70, the horizontal rail portion 61 of the guide rail 60 is guided by the horizontal groove 73 of the guide groove 70. Besides, as illustrated in FIG. 11A, the vertical rail portion 62 of the guide rail 60 is guided by the vertical groove 74 of the guide groove 70. After the guide rail 60 is inserted gradually to the guide groove 70, the engagement projection 63, which is provided in the vertical rail portion 62, reaches the insertion end of the guide groove 70. Then, as illustrated in FIG. 11B, the partition wall 72 undergoes elastic deformation to enlarge the gap between the engagement surface 75 and the partition wall 72, and thus permitting the engagement projection 63 to pass through the gap. Then, as illustrated in FIG. 11C, when the guide rail 60 reaches its stroke end position, the shroud 50 is in a predetermined fitted position with respect to the dispenser main body 10 accordingly. At this time, the engagement projection 63, which is provided in the guide rail 60, abuts against an inner surface of the partition wall 72, that is to say, the inner surface of the vertical groove 74 that faces to the dispenser main body 10, and the vertical rail portion 62 is drawn to the dispenser main body 10 within the vertical groove 74, and the end surface of the vertical rail portion 62, that is to say, the engagement surface 64 abuts against the engagement surface 75. Thus, when the guide rail 60 reaches its stroke end position, the engagement surface 64, which is provided in the rear end of the vertical rail portion 62 of the guide rail 60, comes into undercut engagement with the engagement surface 75 of the dispenser main body 10. Accordingly, the engagement surface 64 of the guide rail 60 engages with the engagement surface 75, and rearward displacement of the guide rail 60 with respect to the guide groove 70 is restricted. Thus, the shroud 50 is held to the dispenser main body 10 while being prevented from slipping off.

Furthermore, once the guide rail 60 reaches its stroke end position, the engagement surface 64 of the guide rail 60 comes into undercut engagement with the engagement surface 75, and the rearward displacement of the guide rail 60 with respect to the guide groove 70 is restricted, as illustrated in FIG. 1, the edge portion of the shroud 50 that is located on the front end side of the bottom wall 53 abuts against an outer circumferential surface of the coupling tube 11 of the dispenser main body 10, thereby regulating forward displacement of the shroud 50 with respect to the dispenser main body 10. The above processes permit the shroud 50 to be held in the predetermined fitted position in the state where the shroud 50 is held to the dispenser main body 10 in the forward and rearward directions.

Moreover, in the state where the guide rail 60 has reached its stroke end position, the guide rail 60 is supported from below by the corresponding disengagement prevention rib 76. With the above configuration, even when a user applies significant force to the shroud 50 in the upper-lower direction, the shroud 50 is prevented from being disengaged due to downward displacement of the guide rail 60 undergoing elastic deformation.

Figure 14:
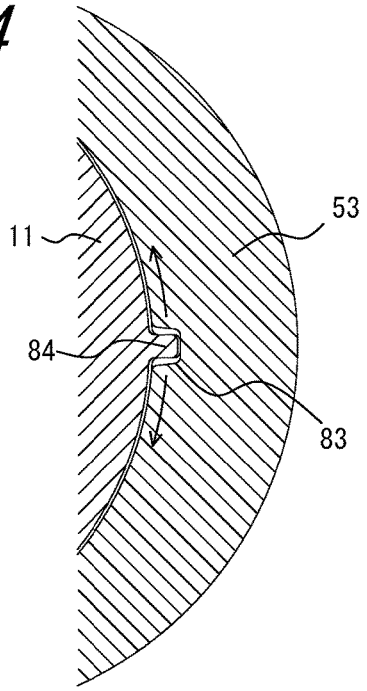
FIG. 14 is a sectional view taken along C-C in FIG. 12.

Moreover, as illustrated in FIG. 14, when the edge portion of the front end side of the shroud 50 abuts against the outer circumferential surface of the coupling tube 11 of the dispenser main body 10, a rear-side rib 84, which is provided on the outer circumferential surface of the coupling tube 11 and which extends rearward, is fitted into a cut-out 83, which is provided on the front end side of the bottom wall 53 of the shroud 50. Consequently, displacement of the shroud 50 in the left and right directions (in directions of arrows in FIG. 14) with respect to the dispenser main body 10 is also restricted. Accordingly, the shroud 50 is held in the predetermined fitted position in the state where the shroud 50 is ensured to be held to the dispenser main body 10 not only in the front-rear direction but also in the left-right direction.

Additionally, to restrict the forward displacement of the shroud 50 with respect to the dispenser main body 10, it is not necessarily needed to adopt the configuration in which the edge portion of the front end side of the bottom wall 53 included in the shroud 50 is brought into abutment with the outer circumferential surface of the coupling tube 11 of the dispenser main body 10, and various other configurations may be adopted. For example, the front end portion of the guide rail 60 may be brought into abutment with a stopper provided in the guide groove 70. Other portions of the shroud 50 may also be brought into abutment with portions of the dispenser main body 10 that correspond thereto.

In this way, the guide rail 60, which is provided in the shroud 50, is configured to include the horizontal rail portion 61 and the vertical rail portion 62. Furthermore, by causing the guide rail 60 to slide-engage with the guide groove 70, which includes the horizontal groove 73, configured to support the horizontal rail portion 61, and the vertical groove 74, configured to support the vertical rail portion 62, and by bringing the engagement surface 64 of the guide rail 60 into undercut engagement with the engagement surface 75, provided in the dispenser main body 10, by the engagement projection 63, provided in the guide rail 60, the shroud 50 is slide-fitted to the dispenser main body 10. Accordingly, with the simple configuration in which the guide rail 60, provided in the shroud 50, slide-engages with the guide groove 70, provided in the dispenser main body 10, both the side walls 52 of the shroud 50, which are fitted to the dispenser main body 10, are prevented from being expanded to the left and right, and the shroud 50 is prevented from slipping off in the upper-lower direction, in the left-right direction, and in the front-rear direction (i.e. the sliding direction). Consequently, the configuration of the shroud 50 is simplified by omitting the need for providing, in the ceiling wall 51 and the bottom wall 53, claw portions for undercut engagement. Accordingly, the configuration of the mold used for injection molding the resin material into the shroud 50 is also simplified, and the manufacturing cycle is accelerated, and productivity of the shroud 50 is enhanced.

Furthermore, since the engagement projection 63 of each guide rail 60 is the only portion of the shroud 50 that comes into undercut engagement to hold the shroud 50 to the dispenser main body 10 while preventing the slipping-off, quality management in manufacturing the shroud 50 is facilitated.

Moreover, since the configuration of the shroud 50 is simplified by omitting the need for providing, in the ceiling wall 51 and the bottom wall 53, claw portions for undercut engagement, deformation due to shrinkage of the resin material occurs in less areas after injection molding. Accordingly, an external good appearance of the shroud 50 is improved.

Moreover, the length of the guide rail 60 in the front-rear direction is sufficiently smaller than the length of the side wall 52 of the shroud 50 in the front-rear direction so that the front end portion of the guide rail 60 is located away from the front end edge of the side wall 52 of the shroud 50 and that the rear end portion of the guide rail 60 is located away from the rear end edge of the side wall 52 of the shroud 50. Accordingly, even the shrinkage of the resin material in the portion provided with the guide rail 60 is reduced, and the external good appearance of the shroud 50 is improved in the portion.

Figure 6:
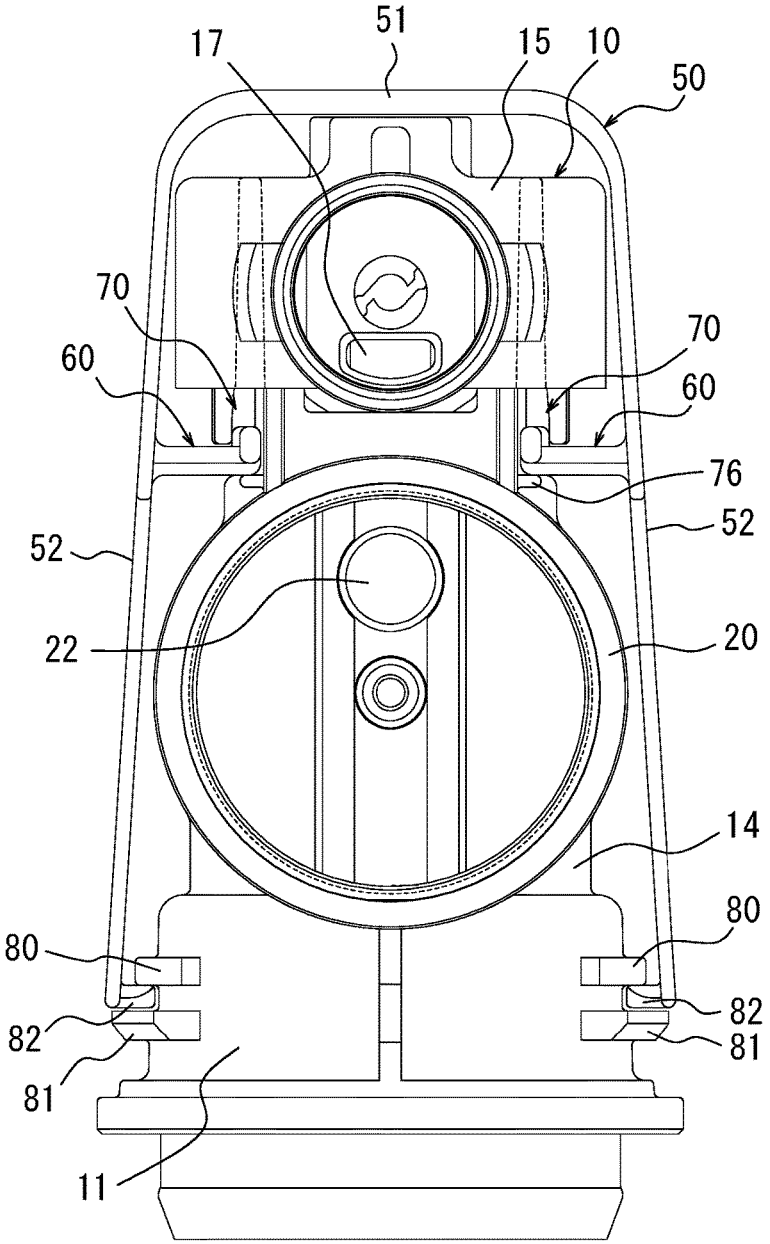
FIG. 6 is a front view illustrating a dispenser main body (from which a piston is removed and) to which a shroud is fitted.
Figure 7:
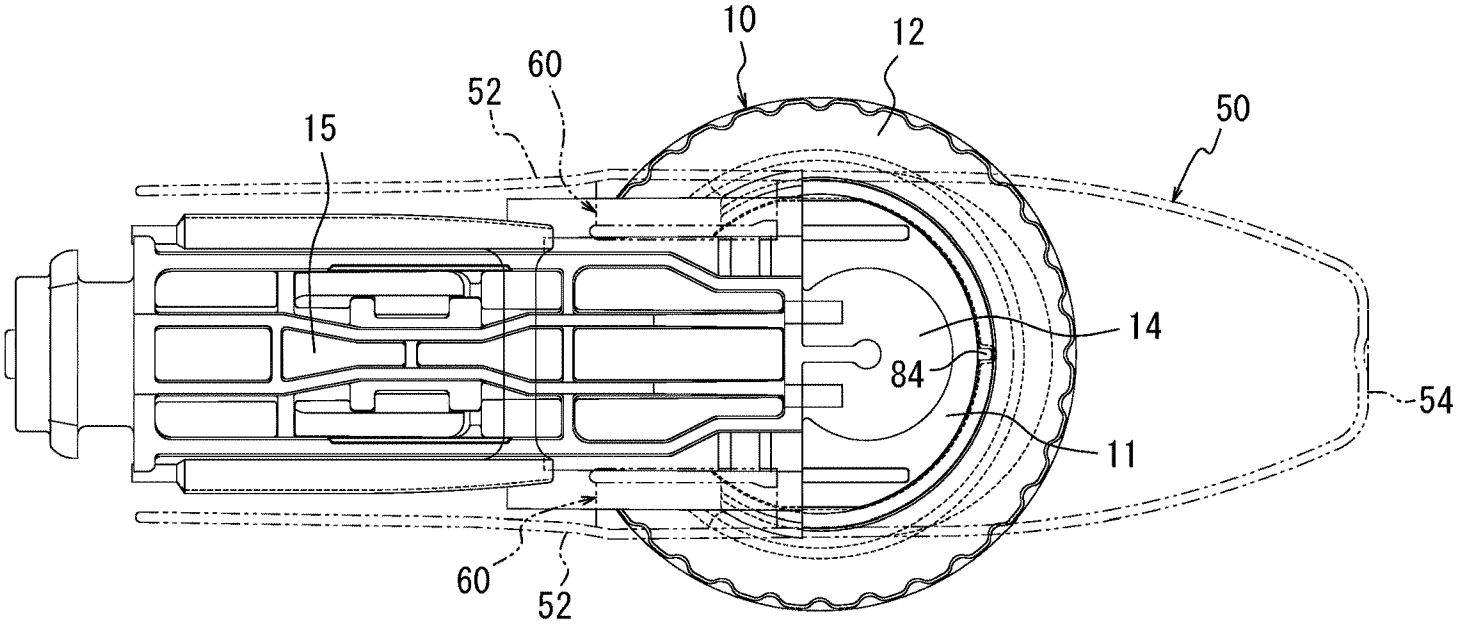
FIG. 7 is a plan view illustrating a shroud of a dispenser main body of FIG. 6 by a two-dot chain line.
Figure 10B:
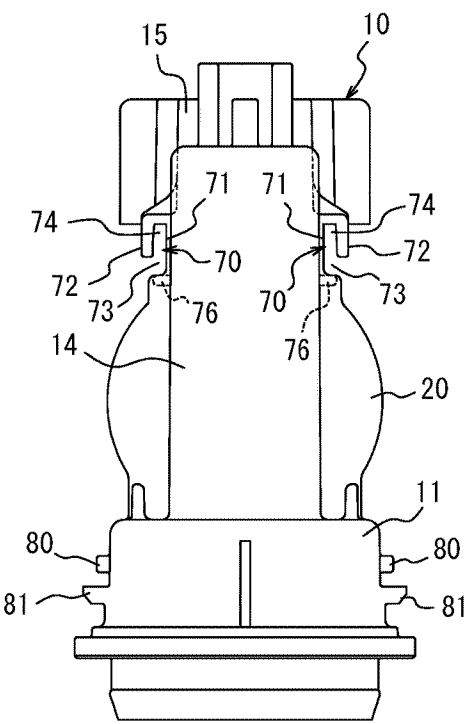
FIGS. 10A and FIG. 10B are respectively a side view and a back view illustrating a dispenser main body (from which a piston is removed) of FIG. 1.
Figure 10A:
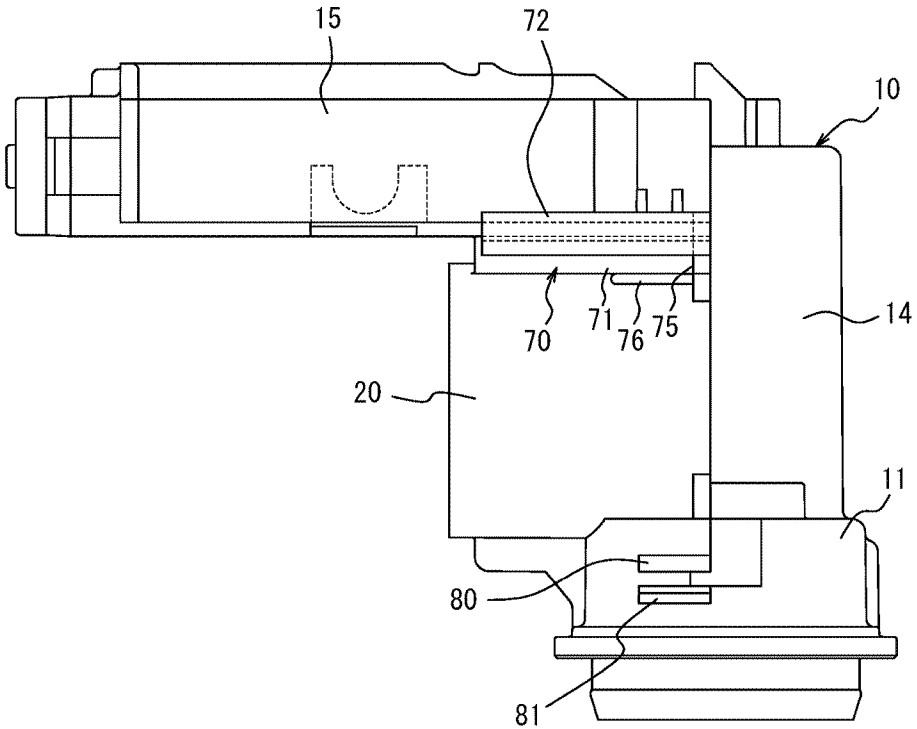

As illustrated in FIGS. 6, 10A, and 10B, on each side portion of the coupling tube 11, which is included in the dispenser main body 10, there is integrally provided a pair of plate-shaped pieces 80 and 81, one on top of the other. On the other hand, as illustrated in FIGS. 6, 8A, 8B, and 8C, on an inner surface of a lower end portion of each side wall 52, which is included in the shroud 50, a guide rib 82 is provided. As illustrated in FIG. 6, when the shroud 50 is fitted in the predetermined fitted position with respect to the dispenser main body 10 by the guide rail 60 reaching its stroke end position, the guide ribs 82 are each fitted between the corresponding pair of plate-shaped pieces 80 and 81 to be supported in the upper-lower direction.

By thus configuring the shroud 50 to be supported by the dispenser main body 10 by the engagement between the guide rib 82 and the pair of plate-shaped pieces 80 and 81, in addition to the engagement between the guide rail 60 and the guide groove 70, in the state where the shroud 50 is fitted in the predetermined fitted position with respect to the dispenser main body 10, the shroud 50 is fitted to the dispenser main body 10 more firmly and securely. Furthermore, the use of the disengagement prevention rib 76 further reinforces the fitting in the upper-lower direction by preventing disengagement between the guide rail 60 and the guide groove 70 and also reinforces the fitting in the left-right direction by permitting the rear-side rib 84 to be fitted into the cut-out 83. The above configuration prevents the shroud 50, even when being applied with load in any of the upper, lower, left, right, front, and rear directions, from being disengaged or displaced from the dispenser main body 10.

Moreover, as illustrated in FIG. 6, when the shroud 50 is fitted in the predetermined fitted position with respect to the dispenser main body 10 by the guide rail 60 reaching its stroke end position with respect to the guide groove 70, an inner surface of the ceiling wall 51 of the shroud 50 is in abutment with an upper surface of the extension portion 15 of the dispenser main body 10.

By thus configuring the shroud 50 to be supported by the dispenser main body 10 by the abutment between the inner surface of the ceiling wall 51 of the shroud 50 and the upper surface of the extension portion 15 of the dispenser main body 10, in addition to the engagement between the guide rail 60 and the guide groove 70, in the state where the shroud 50 is fitted in the predetermined fitted position with respect to the dispenser main body 10, the shroud 50 is fitted to the dispenser main body 10 more firmly and securely.

Additionally, although in the present embodiment the engagement projection 63 is provided on the inner surface of the vertical rail portion 62 of the guide rail 60, the engagement projection 63 may be provided on an outer surface of the vertical rail portion 62 that faces to the dispenser main body 10. Furthermore, the engagement projection 63 does not necessarily need to be provided in the vertical rail portion 62 and may be provided in the horizontal rail portion 61.

Although the configuration and advantageous effects of the present disclosure have been described above, the trigger-type liquid dispenser according to the present disclosure is not limited to the above embodiment, and various changes may be made within the scope of the claims. For example, although in the above embodiment the cylinder is configured as a separate member from the dispenser main body, the cylinder may be provided integrally with the dispenser main body. Furthermore, the upright and inverted dual mechanism may be omitted. Depending on the liquid dispensing mode, the cover may also be omitted.

REFERENCE SIGNS LIST

1: Trigger-type liquid dispenser
2: Container
2*a:* Mouth
2*b:* Male screw
10: Dispenser main body
10*a:* Vent hole
11: Coupling wall
12: Fitting cap
12*a:* Female screw
13: Sealing member
14: Standing portion
15: Extension portion
16: Tube
17: Delivery port
18: Pump
19: Inner tubular wall
20: Outer tubular wall
20*a:* Air intake hole
21: Cylinder
22: Outlet/inlet hole
23: Piston
23*a:* Concave portion
24: Front-side sealing piece
25: Rear-side sealing piece
26: Outer-circumferential-side support portion
27: Inner-circumferential-side support portion
28: Cut-off portion
29: Coupling wall
30: Annular wall
31: Annular wall projection
32: Projection
33: First check valve
34: Second check valve
35: Trigger
36: Pivot shaft
37: Pin member
38: Upright and inverted dual mechanism
38*a:* Valve body
38*b:* Valve chamber
38*c:* Outlet hole
38*d:* Inlet hole
38*e:* Flow path used during inversion
39: Nozzle
39*a:* Dispensing hole
39*b:* Hinge
40: Cover
50: Shroud
51: Ceiling wall
52: Side wall
53: Bottom wall
54: Rear end wall
60: Guide rail
61: Horizontal rail portion
62: Vertical rail portion
63: Engagement projection
63*a:* Flat surface
63*b:* Tilted surface
64: Engagement surface
70: Guide groove
71: Recess
72: Partition wall
73: Horizontal groove
74: Vertical groove
75: Engagement surface
76: Disengagement prevention rib
80: Plate-shaped piece
81: Plate-shaped piece
82: Guide rib
83: Cut-out
84: Rear-side rib
P1: Standing flow path
P2: Extension flow path
S: Plate spring

The invention claimed is:

1. A trigger-type liquid dispenser comprising a dispenser main body fitted to a mouth of a container containing a liquid, a nozzle disposed on a downstream side of a flow path provided in the dispenser main body, and a pump that is actuated in response to operation of a trigger to pressure-feed the liquid contained in the container to the nozzle through the flow path, wherein the pump includes:

a cylinder that has a coaxial double-wall configuration including an inner tubular wall and an outer tubular wall and that communicates with the flow path;

a piston that is fitted displaceably between the inner tubular wall and the outer tubular wall in a direction extending along a center axis of the cylinder and that has a front-side end portion engaged with the trigger;

a front-side sealing piece and a rear-side sealing piece that each are provided integrally in the piston and that each abut against an inner circumferential surface of the outer tubular wall in a liquid-tight manner;

an outer-circumferential-side support portion that is provided integrally in the piston on a front side of the front-side sealing piece and that slidably abuts against the inner circumferential surface of the outer tubular wall; and an inner-circumferential-side support portion that is provided integrally on at least one of an outer circumferential surface of the inner tubular wall and an inner circumferential surface of the piston and that slidably abuts against another one of the outer circumferential surface of the inner tubular wall and the inner circumferential surface of the piston, the outer-circumferential-side support portion is provided with an annular cut-off portion that forms a gap between the outer-circumferential-side support portion and an outer circumferential surface of the piston, the piston is provided with a coupling wall that protrudes from the outer circumferential surface of the piston toward the outer tubular wall, and the outer-circumferential-side support portion is configured by an annular wall and a plurality of annular wall projections, the annular wall being coupled to an outer circumferential end of the coupling wall and extending to the front side, and the plurality of annular wall projections being provided on an outer circumferential surface of the annular wall at an interval in a circumferential direction to slidably abut against the inner circumferential surface of the outer tubular wall, the front-side sealing piece is formed in an umbrella shape that is coupled to the annular wall on a rear side of the annular wall projections and that has a diameter increasing toward the rear side, and the rear-side sealing piece is formed in an umbrella shape that is coupled to the outer circumferential end of the coupling wall and that has a diameter increasing toward the rear side.

2. The trigger-type liquid dispenser according to claim 1, wherein the inner-circumferential-side support portion is configured by a plurality of projections that is disposed at an interval in a circumferential direction.

* * * * *